United States Patent [19]

Bennett

[11] 4,228,587

[45] Oct. 21, 1980

[54] COMBINED RAZOR HOLDER AND SHAVING FLUID DISPENSER

[76] Inventor: Charles H. Bennett, 8320 Russell St., Utica, Mich. 48087

[21] Appl. No.: 35,252

[22] Filed: May 2, 1979

[51] Int. Cl.[3] ..... B26B 21/44

[52] U.S. Cl. ..... 30/41; 30/86

[58] Field of Search ..... 30/41, 62, 86, 47

[56] References Cited

U.S. PATENT DOCUMENTS

| | | | |
|---|---|---|---|
| 843,923 | 2/1907 | Arnold | 30/47 |
| 953,230 | 3/1910 | Rash | 30/47 X |
| 2,131,498 | 9/1938 | Chandler | 30/41 |
| 2,349,252 | 5/1944 | Douglass | 30/62 X |
| 2,447,358 | 8/1948 | Neuburger | 30/41 |
| 2,669,017 | 2/1954 | Seko | 30/41 X |
| 3,349,484 | 10/1967 | Zeles | 30/86 X |
| 4,074,428 | 2/1978 | Roberts | 30/86 X |

*Primary Examiner*—Jimmy C. Peters
*Attorney, Agent, or Firm*—Learman & McCulloch

[57] ABSTRACT

A reusable, pocket-size container, having a chamber for holding a shaving lather and adapted to be gripped by the hand of the shaver, has an open-ended well in its upper end which is separated from the lather chamber and configured to receive a disposable safety razor comprising a stem and an overhanging shaving head. The stem is withdrawable from stored position within the well to a raised position in which it is automatically held in shaving position. It can also be completely withdrawn from the well to permit the replacement of a fully used razor with another. A device is provided to dispense lather from the chamber and a cap is provided for the top of the container to house the components when the device is not in use.

10 Claims, 6 Drawing Figures

COMBINED RAZOR HOLDER AND SHAVING FLUID DISPENSER

FIELD OF THE INVENTION

The present invention relates generally to combined razor holders and shaving lather dispensers of the type which both dispense a shaving lotion or lather and provide a blade for shaving purposes. The invention relates to improvements in devices of the character generally disclosed in prior U.S. Pat. Nos. 1,744,902; 2,501,987; 2,743,732; 2,886,265; 3,176,391; 3,426,769; 3,703,765; 3,726,109; 3,985,146; 4,074,428; and 4,077,119.

BACKGROUND OF THE INVENTION

The present invention relates to a compact, portable combined shaving liquid dispenser and razor holder which is extremely useful for the purpose of providing quick or emergency shaves for those who, in the modern business world, find themselves temporarily without the usual home shaving facilities. As such, the invention contemplates a device of about the size of a conventional package of cigarettes which can be gripped by the hand of a user employing the device to shave. A reusable refillable container, which contains sufficient lather for a number of shaves is provided and the device further utilizes a disposable safety razor which can be discarded after its blade has been used a number of times.

OBJECTS OF THE INVENTION

It is an object of the present invention to provide a combined shaving lather dispenser and razor holder in which the lather holder and dispenser is refillable and useful as a handle for a disposable razor which can be moved from a retracted position to a shaving position, and thus discarded when its blade has dulled.

Another object of the invention is to provide a shaving device of the character described which is particularly useful for travelers, for example, and yet provides more than a single shave.

Still another object of the invention is to provide a shaving device which, after use, can be readily cleaned and stored sanitarily for future use.

Another further object of the invention is to provide a shaving device of the character described which has few parts, is appealing to prospective users, and can be sufficiently inexpensively constructed that it is commercially practical.

SUMMARY OF THE INVENTION

The afore-mentioned and other objects of the invention are satisfied by providing an inexpensive, portable, compact shaving device which includes a lather-filled container having its top wall formed to provide a separate, open-ended well for receiving the stem of a disposable safety razor. The well and stem are provided with automatic stop mechanism which permits the stem to be pulled from a fully retracted storage position to a partially retracted shaving position in which the razor is held rigidly for shaving. While both the container and razor can be used to shave a number of times, the invention contemplates refilling and sustained use of the container and the replacement of the razor when the razor blade becomes dulled.

Other objects, features, and advantages of the present invention will become apparent with perusal of the detailed description of the preferred embodiment of the invention when taken in conjunction with the appended drawings, wherein.

DETAILED DESCRIPTION

Figure 5:
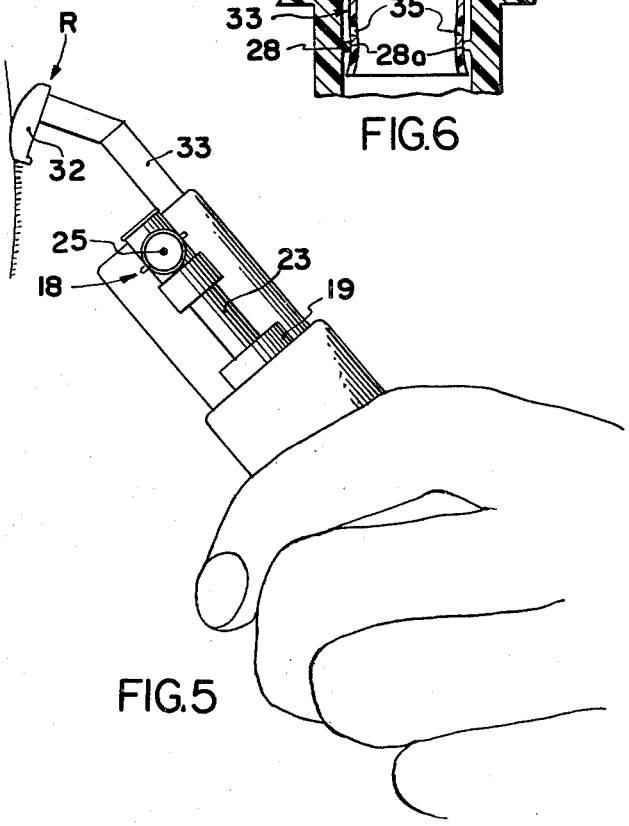
FIG. 5 is a side elevational view illustrating the manner in which the device is used for shaving.

Referring now more particularly to the drawings, the combined razor holder and shaving fluid dispenser of the present invention comprises a one-piece molded plastic container generally designated C which is necked in or shouldered as at 10 to frictionally accommodate a closure cap 11. As will be apparent from the drawings, the container C which has an interior shaving lather holding chamber 12 is generally oblong in shape and is larger in its width dimension (see FIG. 1) than in its depth dimension (see FIG. 2). In practice, the fully bassembled container, as disclosed in FIG. 1, will be of about the size a of package of cigarettes and will be easily gripped by the hand of the shaver, as FIG. 5 indicates.

The container C is to be a refillable container capable of sustained use and, therfore, is preferably molded of a suitable plastic such as polypropylene or one of the other polyolefins in the wall thickness indicated, provides a substantially rigid body. The chamber 12 is subject to refilling via a removable screw 13, threadly received in the boss or sleeve 14 molded into the bottom of container C. It will be seen that the container C is of special shape and that its top wall, which I have generally designated 15, is stepped down as at 16 for the purpose of forming a recess 17 within which the upper end of a conventional dispenser 18 can be housed. Dispenser 18 can be, for instance, the spring returned, top push, vacuum pump which is commonly used to dispense window cleaning solution, for instance, and is marketed by Drackett Corporation of Cincinnati, Ohio. Such devices include a mount 19 having a threaded sleeve 20 secured in threaded opening 21 provided in an increased thickness top wall portion 22 of casing C. Such devices incorporate a depressable sleeve 23 having a nozzle 24 with a dispensing outlet 25. When the sleeve 23 is depressed by pushing downwardly on its top surface 26, a vacuum is created by the pump which causes shaving lotion drawn into the open ended inlet tube 20*a* to be ejected in the form of a charge of lotion through outlet opening 25 to the hand of a shaver who then can rub it on his beard in the usual manner. Alternatively, a dispensing device of the character disclosed in U.S. Pat. No. 3,426,769, which is quite similar, may be used.

Figure 4:
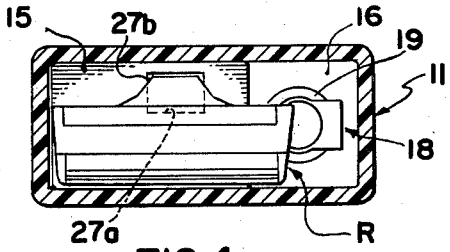
FIG. 4 is a sectional top plan view taken on the line 4—4 of FIG. 1.

Molded in the top wall 15 of the container casing C is a well 27 which extends generally vertically parallel to the recess 17 provided to house the dispenser 18. As FIG. 1 indicates, the well 27 is generally centrally located relative to the end walls e of the casing, but is off centrally located with respect to the sidewalls s of casing C (see FIGS. 2 and 4). It will be seen that the well 27 is also oblong in shape and includes sidewalls 27*a* and end walls 27*b*. The sidewalls 27*a* include lower and upper vertically spaced projections 28 and 29, respectively, provided with curvlinear stem-confronting surfaces 28*a* and 29*a*.

Figure 6:
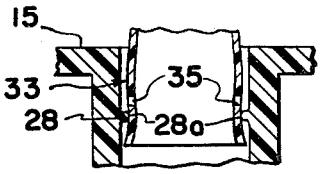
FIG. 6 is an enlarged sectional fragmentary view illustrating the manner in which the razor stem deforms to permit it to be moved within and up out of the well.

The disposable razor I have generally designated R is of the safety razor type and comprises a one-piece plastic mass molded of polypropylene or another suitable plastic material. In this disposable construction, the blade insert 30 which has cutting edge 30*a* opposite slotted opening 31 is molded directly into the enlarged over-hanging head 32 for tapered razor stem 33. It will be observed that the stem 33 is tubular and that is has vertically spaced apart upper and lower openings or recesses 34 and 35 provided in stem end walls 36. The thickness of walls 36, and also stem sidewalls 37, is such that the deformation shown in FIG. 6 can take place when the stem 33 is pulled upwardly or pushed downwardly with sufficient force to cause the projections 28 and 29 to deform the sidewalls of the stem as they move out of and past projections 28 and 29. As FIG. 6 indicates, when the stem 33 is pulled upwardly or pushed downwardly, the curvilinear surfaces 28*a* and 29*a* cam the stem sidewalls 36 inwardly to permit the movement of stem 33 within the well 27. Because the stem 33 tapers slightly, the projections 29 must project inwardly slightly beyond the projections 28.

THE OPERATION

Figure 1:
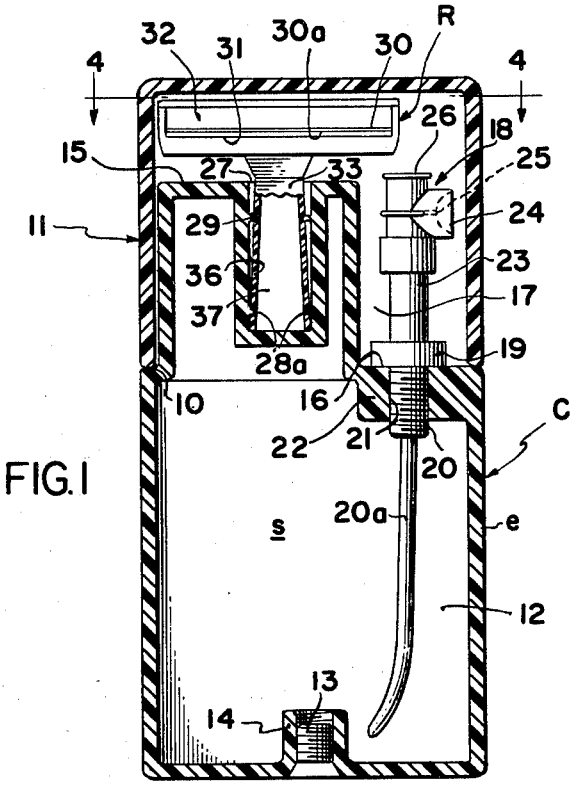
FIG. 1 is a sectional, elevational view showing the disposable razor in stored position and the container cap in place.
Figure 2:
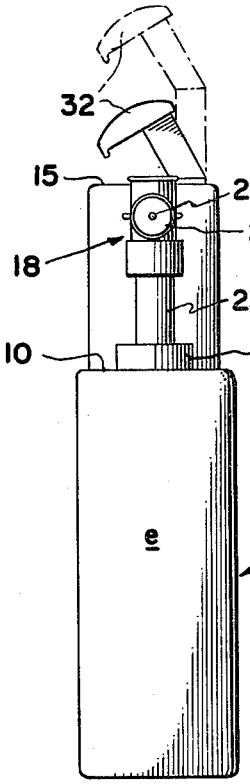
FIG. 2 is an end elevational view thereof, with the cap removed and the broken lines indicating a raised position of the razor in which the device is ready for use as a shaving implement.
Figure 3:
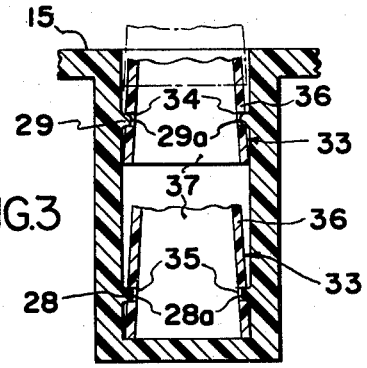
FIG. 3 is an enlarged, sectional, side elevational view of the razor stem-accommodating well, the lower end of the razor stem being shown fragmentarily in two different positions and the chain lines indicating the manner in which the razor may be completely removed from the well to permit razor replacement.

In the storage position illustrated in FIG. 1, razor stem 33 is held in retracted position by virtue of the engagement of projections 28 and 29 in the openings 34 and 35 provided in stem 33. When it is desired to use the shaving implement to shave a surface such as the bearded face surface shown in FIG. 5, the cap 11, which is frictionally or otherwise suitably interengaged in position on container C, is pulled upwardly and removed. As indicated earlier, to obtain shaving lotion to rub on the face is a simple matter of depressing stem sleeve 26 to receive lather from the dispensing opening 25. The user then grasps the head 30 of razor R and pulls the stem 33 upwardly to move razor R to the broken line position shown in FIG. 2. When he exerts sufficient force, the projections 28 and 29 cam the sidewalls 36 of razor stem 33 inwardly sufficiently to permit the lower end of the razor stem 33 to move from the lower position shown in FIG. 3 to the upper position in which projections 29 are engaged in opening 35. In this position, the interengagement of projections 29 in openings 35 is sufficient to hold the razor R rigidly in position.

To remove the razor R completely, for purposes of replacement, the user may simply pull the razor R upwardly (as indicated by the broken line position in FIG. 3) to remove the projections 29 from the openings 35. He may then pull the razor stem 33 completely out of the well 27 and reinsert a replacement razor, pushing it downwardly to the retracted storage position shown in FIG. 1 in which both sets of projections 28 and 29 are engaged in both sets of recesses 35 and 34, respectively.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. In a compact, portable, pocket size, shaving product; a reusable container having a chamber for holding a shaving lotion and configured to be gripped by the hand of a shaver; said container having an open ended vertical well of predetermined length in the upper end of the container, separated from said chamber; and open to the top wall of the container at its upper end; a device for dispensing lather from said container; a disposable safety razor comprising a stem with an overhanging head having an exposed blade; the stem being of a cross-sectional size and shape to be received in said well; releasable means cooperating between said well and stem for releasably holding said stem in a lowermost position in which the razor head is adjacent the top wall of the container in stored position; and in a raised position extended from said well substantially, in which the head is in shaving position; the said releasable means permitting withdrawal of the stem from the well entirely to permit the replacement of one razor with another; and a removable container cap for the upper end of the container and the exposed safety razor head.

2. The product of claim 1 wherein the top wall of the container is stepped to provide a recess opposite and generally vertically parallel with said well; and a dispenser nozzle having a portion extending into said lather chamber is housed in said recess so that the razor head can extend partly out over said recess and nozzle.

3. The product of claim 1 wherein the container and cap are oblong in shape and have a greater width than depth; and the well is substantially centrally disposed widthwise while being off-centrally disposed in a depthwise direction.

4. The product of claim 1 wherein said releasable means comprises stop surfaces on the interior wall of the well and the stem, the surfaces on one being vertically spaced to hold the razor in retracted and shaving positions.

5. The product of claim 4 in which said vertically the stem is deformable to permit movement of the razor past said vertically spaced surfaces with exertion of a force which cams the stem walls inwardly to a depressed position.

6. The product of claim 5 in which said vertically spaced surfaces comprise curvilinear projections which are seatable in a recess provided in said stem.

7. The product of claim 6 in which said stem is tubular and its walls are flexible relative to the well interior wall.

8. In a pocket size, transportable shaving device; a reusable container, defining a chamber for holding a shaving lather, which can be gripped by the hand of a shaver; and a device for dispensing lather from said container; the improvements wherein: the container has an open ended vertical well in its upper end; a disposable safety razor, comprising a stem with an overhanging head having an exposed blade, has its stem received in said well; and releasable means cooperating between said well and stem is provided for releasably holding said stem in a position partially withdrawn from the well in which the razor head is automatically located and rigidly supported in shaving position; the said releasable means permitting retraction of the stem to razor storing position and withdrawal of the stem from the well entirely to permit the replacement of one razor with another.

9. The device of claim 8 in which said releasable are deformable.

10. The device of claim 9 in which said cam means comprise projections and said stem walls have openings for receiving said projections.

* * * * *

UNITED STATES PATENT AND TRADEMARK OFFICE

CERTIFICATE OF CORRECTION

PATENT NO. : 4,228,587

DATED : October 21, 1980

INVENTOR(S) : Charles H. Bennett

It is certified that error appears in the above-identified patent and that said Letters Patent are hereby corrected as shown below:

Column 1, line 11, change "3,726,109" to -- 3,726,009 --.

Column 2, line 36, change "bassembled" to -- assembled --.

Column 4, line 48, after "vertically" insert -- spaced surfaces are on the interior wall of the well and --.

Column 6, line 3, after "realeasable" insert -- means comprises cam means in the well and the stem walls --.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*